United States Patent [19]

Stegerwald

[11] 3,971,145

[45] July 27, 1976

[54] TENNIS SHOE AND SOLE THEREFOR

[75] Inventor: Harry R. Stegerwald, Cheshire, Conn.

[73] Assignee: Uniroyal Inc., New York, N.Y.

[22] Filed: May 22, 1975

[21] Appl. No.: 580,120

[52] U.S. Cl. ..... 36/32 R
[51] Int. Cl.[2] ..... A43B 13/04
[58] Field of Search ..... 36/2.5 R, 32 R, 9 R, 36/25 R

[56] References Cited

UNITED STATES PATENTS

| | | | |
|---|---|---|---|
| 2,995,840 | 8/1961 | Greenbaum | 36/32 R |
| 3,175,309 | 3/1965 | Witt et al. | 36/32 R |
| 3,875,689 | 4/1975 | Tomas | 36/32 R |

*Primary Examiner*—Patrick D. Lawson
*Attorney, Agent, or Firm*—Charles A. Blank

[57] ABSTRACT

A tennis shoe and a sole therefor having a longer life than a conventional tennis shoe. The Sole has an upwardly extending side portion in a toe region and inside ball-of-the-foot region which is thicker at the junction of the side portion with the bottom portion of the sole than the junction of the upwardly extending side portion with the bottom portion along the remainder of the side boundary of the sole.

7 Claims, 4 Drawing Figures

TENNIS SHOE AND SOLE THEREFOR

Figures 1, 2A, 2B:
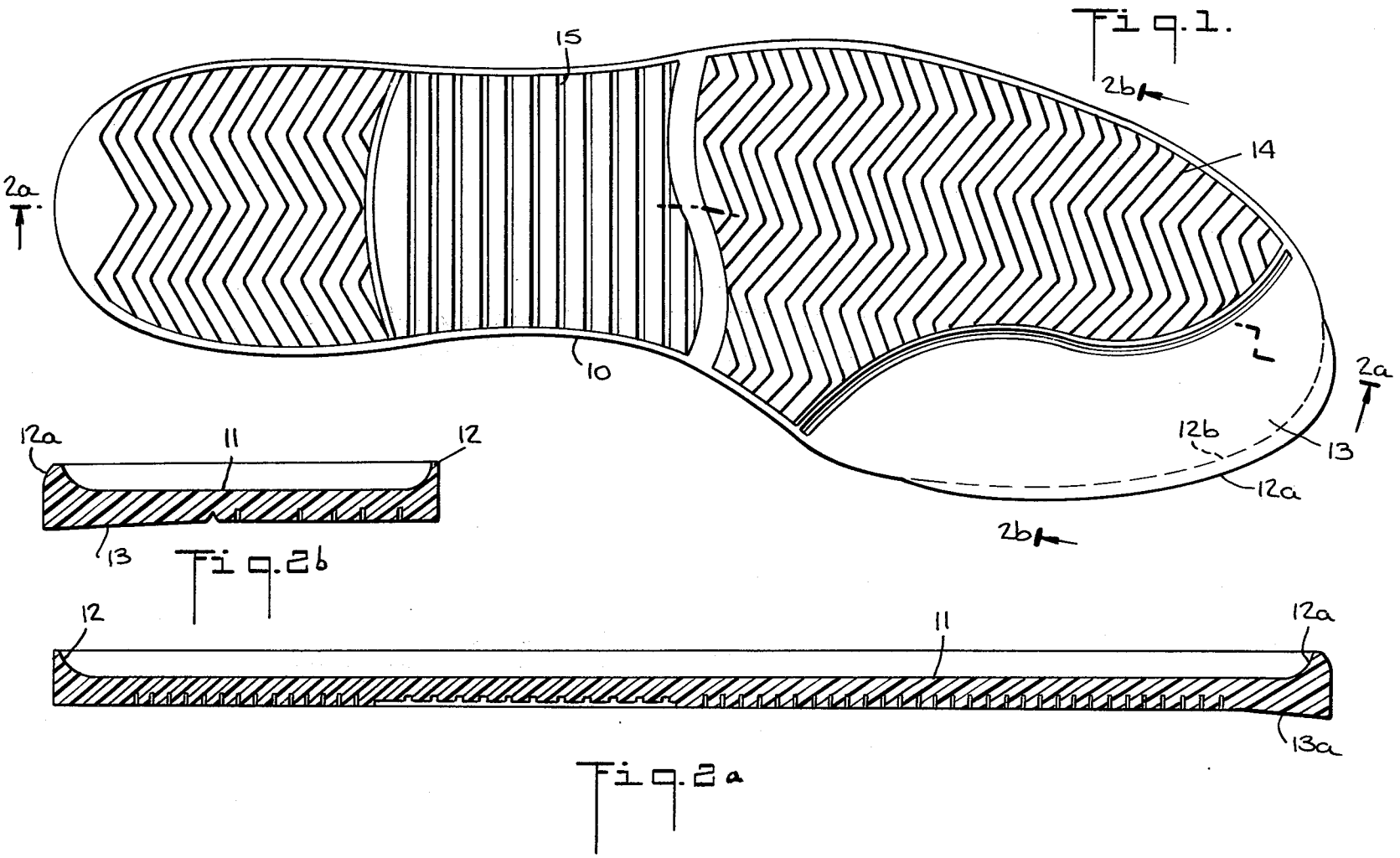

This invention relates to soles for tennis shoes and to tennis shoes.

Due to excessive dragging of the toe during the act of serving, the toe area of the outsole and inside ball-of-the-foot region are areas of excessive wear, causing tennis shoes of the prior art to have shortened lives.

It is an object of the present invention, therefore, to provide a new and improved sole for a tennis shoe which avoids one or more disadvantages of prior such soles.

It is another object of the invention to provide a new and improved sole for a tennis shoe which provides an increased life span for the tennis shoe.

It is another object of the invention to provide a new and improved tennis shoe which avoids one or more disadvantages of prior such shoes.

In accordance with the invention, a sole for a tennis shoe comprises an elastomeric body having an elongated bottom portion and having an upwardly extending side portion having a given thickness at the junction thereof with said bottom portion along the major portion of the side boundary of the aforesaid body, the upwardly extending side portion in a toe region and inside ball-of-the-foot region being thicker at the junction thereof with the bottom portion than the aforesaid given thickness.

Also in accordance with the invention, a tennis shoe comprises an upper, an insole secured to said upper, a foxing secured to said upper, and an outsole secured to the insole and the foxing and comprising an elastomeric body having an elongated bottom portion and having an upwardly extending side portion having a given thickness at the junction thereof with the bottom portion along the major portion of the side boundary of the aforesaid body, the upwardly extending side portion in a toe region and inside ball-of-the-foot region being thicker at the junction thereof with the bottom portion than the aforesaid given thickness.

For a better understanding of the present invention, together with other and further objects thereof, reference is made to the following description, taken in connection with the accompanying drawings, and its scope will be pointed out in the appended claims.

Figure 3:
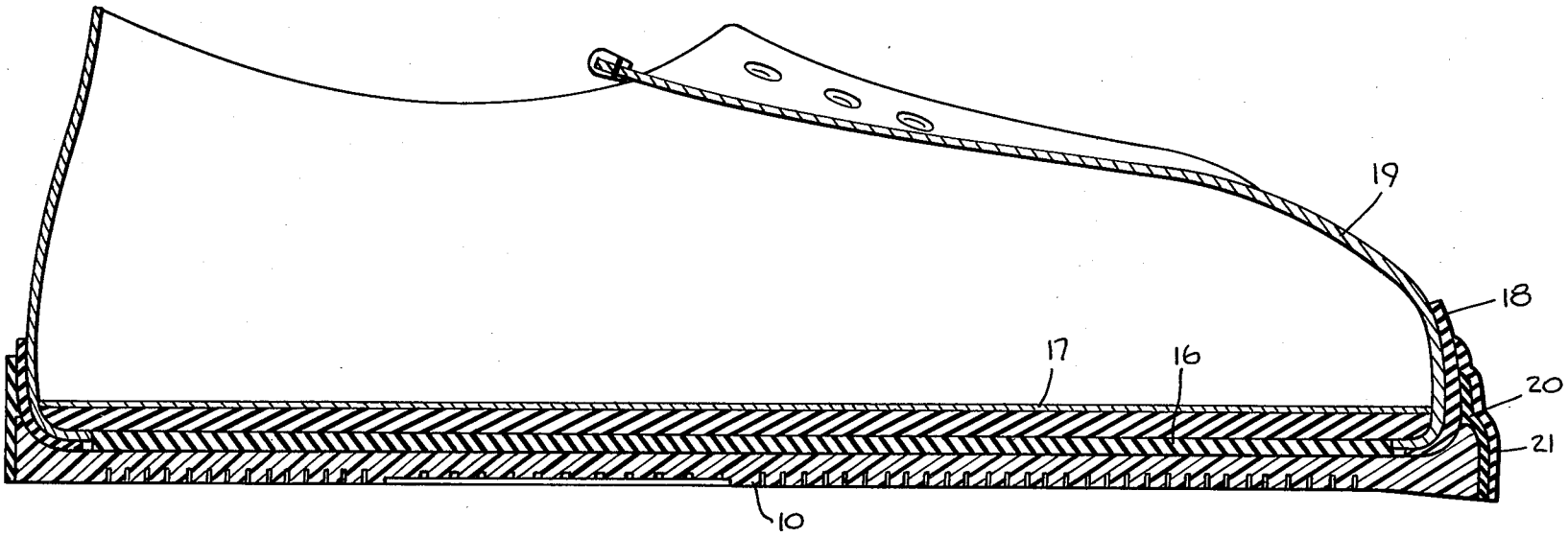

Referring now to the drawings:

FIG. 1 is a bottom plan view of a sole constructed in accordance with the invention;

FIG. 2*a* is a sectional view of the FIG. 1 sole, taken along the line 2*a*—2*a* of FIG. 1;

FIG. 2*b* is a sectional view of the FIG. 1 sole, taken along the line 2*b*—2*b* of FIG. 1; and FIG. 3 is a sectional view of a tennis shoe constructed in accordance with the invention.

Referring now more particularly to FIGS. 1, 2*a* and 2*b* of the drawings, a sole 10 for a tennis shoe comprises an elastomeric body having an elongated bottom portion 11 and having an upwardly extending side portion 12 having a given thickness at the junction thereof with the bottom portion 11 along the major portion of the side boundary of the body. The sole 10 may be of natural or synthetic elastomer but preferably is of expanded polyurethane of a formulation set forth hereinafter.

The upwardly extending side portion 12 in a toe region and inside ball-of-the-foot region 12*a* is thicker at the junction thereof with the bottom portion than the given thickness of the remainder of the upwardly extending side portion 12. More particularly, the upwardly extending side portion 12 in the toe region and inside ball-of-the-foot region 12*a* preferably is thicker by about ⅛ inch at the junction thereof with the bottom portion than the given thickness of the remainder of the upwardly extending side portion 12, as represented in FIG. 2. The thickened side portion is represented in FIG. 1 by the distance between the broken line 12*b* and the outer edge of the region 12*a*.

The thickened side portion 12*a* preferably is thicker than the remainder of the side portion 12 for at least about 1/16 inch above the junction of the side portion with the bottom portion 11.

The bottom portion 11 has a rough surface area in the toe and inside ball-of-the-foot region, as represented by the area 13 in FIG. 1. The bottom portion in the area 13 is tapered to be thicker at the outer edge of the toe and inside ball-of-the-foot region than the remainder of the sole, as represented in FIGS. 2*a* and 2*b*. The bottom portion in the area 13 preferably is tapered to be about 1/16 inch thicker at the outer edge of the toe and inside ball-of-the-foot region than the remainder of the sole.

The sole 10 has slits 14 in a herring bone pattern which are located in the ball-of-the-foot area and across the heel area, providing the necessary traction to the wearer. The shank area of the sole has horizontal bars 15, which provide lateral stability for the sole.

The sole 10 preferably is formed by casting into a mold but may be formed by injection molding or any other suitable method.

The polyurethane recipe for the sole 10 preferably is as follows:

| Ingredient | PHP* |
|---|---|
| Vibrathane B602 (Uniroyal)[1] | 100 |
| Metaphenylenediamine | 4 |
| Santicizer S-160 (Monsanto)[2] | 5.5 |
| Silicone Fluid PFA 1200 (G.E.)[3] | .5 |
| Nitrosan Blowing Agent (DuPont)[4] | .52 |
| Santicizer S-140 (Monsanto)[5] | .52 |
| Dispersant (Fuel oil additive)[6] (DuPont) | .006 |
| Pigment in Plasticizer | 2.35 |
| Total | 113.396 |

*Based on Parts per Hundred of Prepolymer

[1]Polytetramethyleneglycol based prepolymer with TDI (toluene diisocyanate), Molecular weight 2700.

[2]Butyl benzyl phthalate

[3]Silicone surfactant (plastic foam additive).

[4]N,N'-dinitroso-N,N' dimethyl teraphthalamide.

[5]Cresyl diphenyl phosphate.

[6]50% organic compound copolymer in kerosene.

Other materials such as rubber or plastic based materials can also be used for the sole 10.

As represented in FIG. 3, which is a cross section of a tennis shoe constructed in accordance with the invention, the outsole 10 may be attached by a conventional rubber binder 16 to the insole 17 which may be of any suitable expanded elastomer material. The outsole 10 also is attached to an upper 19 of conventional material such as fabric or leather using a suitable adhesive. An elastomer foxing 18 is attached to upper 19 and to the outsole 10 using a common adhesive for this purpose. Also, a fabric-reinforced or friction foxing is attached to foxing 18 and outsole 10 using a suitable adhesive. An elastomeric bumper 21 extending around the toe and ball-of-the-foot region is attached to the foxings 18 and 20. The upwardly extending side portion 12 may be buffed to improve adhesion of the various members of the shoe thereto.

From the foregoing description it will be seen that the thicker upwardly extending side portion 12*a* provides a longer life for the sole 10 and for the tennis shoe, giving increased wear in the critical area of the shoe when the toe of the shoe is dragged during the act of serving. Also, the increased thickness of the bottom portion of the sole 10 in the region 13 causes the sole 10 and the tennis shoe to have a longer life.

While there has been described what at present is believed to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

I claim:

1. A sole for a tennis shoe comprising:

an elastomeric body having an elongated bottom portion and having an upwardly extending side portion having a given horizontal thickness at the junction thereof with said bottom portion along the side boundary of said body except in a toe region and an inside ball-of-the-foot region, said upwardly extending side portion in said toe region and inside ball-of-the-foot region being horizontally thicker at the junction thereof with said bottom portion than said given thickness.

2. A sole in accordance with claim 1 in which said junction of said upwardly extending side portion in said toe region and said inside ball-of-the-foot region is thicker by about ⅛ inch than said given thickness.

3. A sole in accordance with claim 1 in which said upwardly extending side portion in said toe region and said inside ball-of-the-foot region is thicker for at least about 1/16 inch above said junction thereof with said bottom portion than said upwardly extending side portion along said side boundary of said body, except in said toe region and said inside ball-of-the-foot region, at the same distance above said junction thereof with said bottom portion.

4. A sole in accordance with claim 1 in which said bottom portion is tapered in said toe region and said inside ball-of-the-foot region to be thicker at the outer edge of said toe region and said inside ball-of-the-foot region than the remainder of said bottom portion of said sole.

5. A sole in accordance with claim 4 in which said outer edge of said bottom portion in said toe region and said inside ball-of-the-foot region is about 1/16 inch thicker than said remainder of said bottom portion of said sole.

6. A sole in accordance claim 1 in which said elastomeric body is of expanded polyurethane.

7. A tennis shoe comprising:

an upper;

an insole secured to said upper;

a foxing secured to said upper; and an outsole secured to said insole and said foxing and comprising an elastomeric body having an elongated bottom portion and having an upwardly extending side portion having a given horizontal thickness at the junction thereof with said bottom portion along the side boundary of said body except in a toe region and an inside ball-of-the-foot region, said upwardly extending side portion in said toe region and inside ball-of-the-foot region being horizontally thicker at the junction thereof with said bottom portion than said given thickness.

* * * * *

UNITED STATES PATENT AND TRADEMARK OFFICE

CERTIFICATE OF CORRECTION

PATENT NO. : 3,971,145

DATED : July 27, 1976

INVENTOR(S) : Harry R. Stegerwald

It is certified that error appears in the above-identified patent and that said Letters Patent are hereby corrected as shown below:

column 4 line 19 for "accordance claim 1"

read --- accordance with claim 1 ---

Signed and Sealed this

Fourth Day of January 1977

[SEAL]

*Attest:*

RUTH C. MASON
*Attesting Officer*

C. MARSHALL DANN
*Commissioner of Patents and Trademarks*